United States Patent [19]

McGovern

[11] Patent Number: 4,615,253

[45] Date of Patent: Oct. 7, 1986

[54] MOTOR DRIVEN FRETTING BELT DEVICE

[76] Inventor: James R. McGovern, 205 E. 239th St., Bronx, N.Y. 10470

[21] Appl. No.: 417,416

[22] Filed: Nov. 4, 1982

Related U.S. Application Data

[63] Continuation-in-part of Ser. No. 58,675, Oct. 23, 1979, abandoned.

[51] Int. Cl.[4] ..... G10D 3/00

[52] U.S. Cl. ..... 84/317

[58] Field of Search ..... 84/315–317

[56] References Cited

U.S. PATENT DOCUMENTS 3,433,112 3/1969 Bradt ..... 84/317

3,837,255 9/1974 Starns et al. ..... 84/317

4,228,718 10/1980 Smith ..... 84/317

FOREIGN PATENT DOCUMENTS 2089550 6/1982 United Kingdom ..... 84/317

*Primary Examiner*—Lawrence R. Franklin

[57] ABSTRACT

This invented device is a fingerboard key operated motor driven chording belt with a plurality of cams attached to it that are selectively lifted by electromagnet as the belt is driven and caused to ride between an elevated surface and cam wheel-push rod-rocker arm assemblies, and displace the rocker arms, to thus fret the adjacent strings and form any one of thirteen possible chromatic chords for use in playing a musical number on a guitar.

6 Claims, 22 Drawing Figures

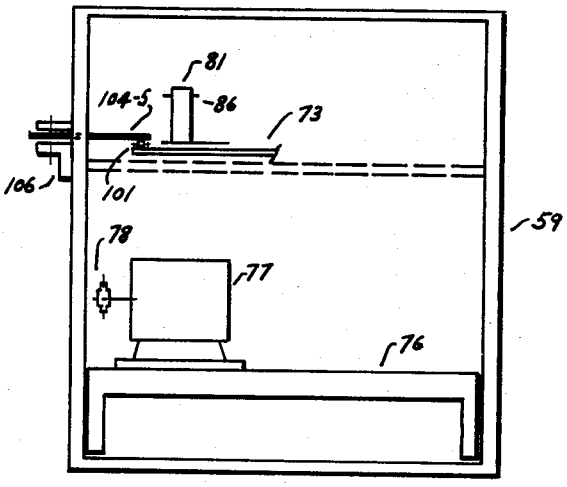
FIG. 6
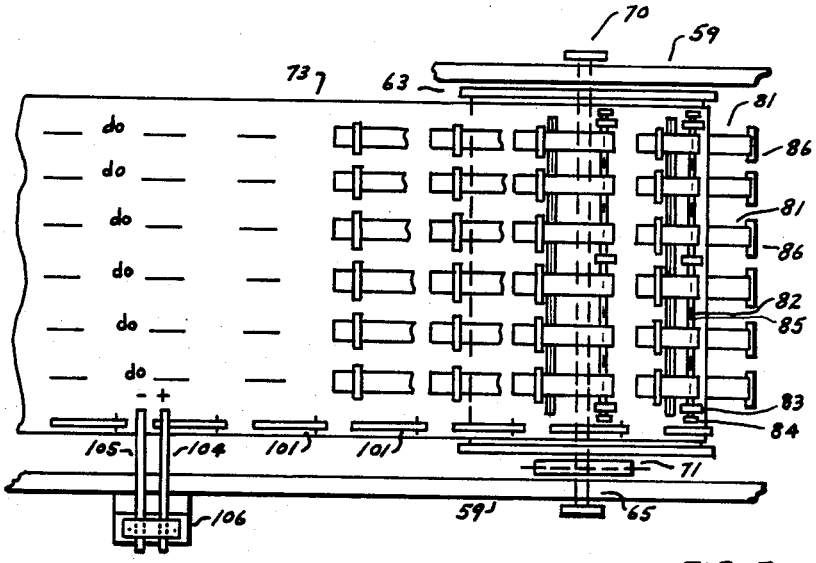
FIG. 7
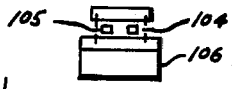
FIG. 11
FIG. 8
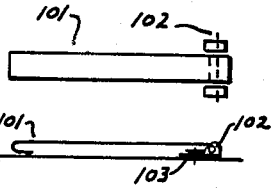
FIG. 9
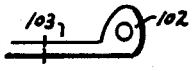
FIG. 10

MOTOR DRIVEN FRETTING BELT DEVICE

This application is a continuation-in-part of Ser. No. 058,675 filed 10/23/79, now abandoned.

BACKGROUND OF THE INVENTION

This invention relates to automatically fretted stringed instruments such as a guitar.

The invention seeks to overcome the problem evident in prior art examples of automatically fretted stringed instruments by providing a means of gradually applying pressure on strings in fretting them so that there is a closer approach to duplicating the conditions of a person fretting strings by hand, where the fingertips are like pliable leather pads that in placement and application give way somewhat but gradually move the string down to engagement with the fret.

SUMMARY OF THE INVENTION

A musical instrument such as a guitar that has a motor driven belt with wedge like bars that are mounted on rotateable cams that are fastened to its outer surface that are attracted by electromagnets that are selectively energized by pressing a key on a finger board, so that when the belt is driven by the motor and the bars are attracted by the electromagnets, the bars ride an elevated surface, which is a bridge, and become wedged between the elevated surface and a wheel that is mounted at the base of a fretting mechanism, thus actuating the mechanism so that string fretting is produced.

BRIEF DESCRIPTION OF THE DRAWINGS

FIG. 6 is an item point of reference overlay of FIG. 3.

FIG. 7 is a plan view of a section of fret belt.

FIG. 8 is a top view of an elongated metal strip secondary motor circuit bridge.

FIG. 9 is a side view of FIG. 8.

FIG. 10 is an enlarged view of the bracket fastening of an elongated metal strip secondary motor circuit bridge.

FIG. 11 is an end view of the secondary motor circuit bar contacts.

An automatically fretted stringed instrument has a motor driven belt with wedge like cam bars that are mounted on cams that are fastened to the outer surface of the belt.

Keys on a fingerboard are pressed to selectively energize electromagnets that attract the cam bars and cause them to ride along a bridge surface and then wedge between the surface and a wheel at the base of a fretting mechanism and actuate the mechanism so that fretting pressure is gradually applied on the instruments strings.

DESCRIPTION OF THE PREFERRED EMBODIMENT

Figure 1:
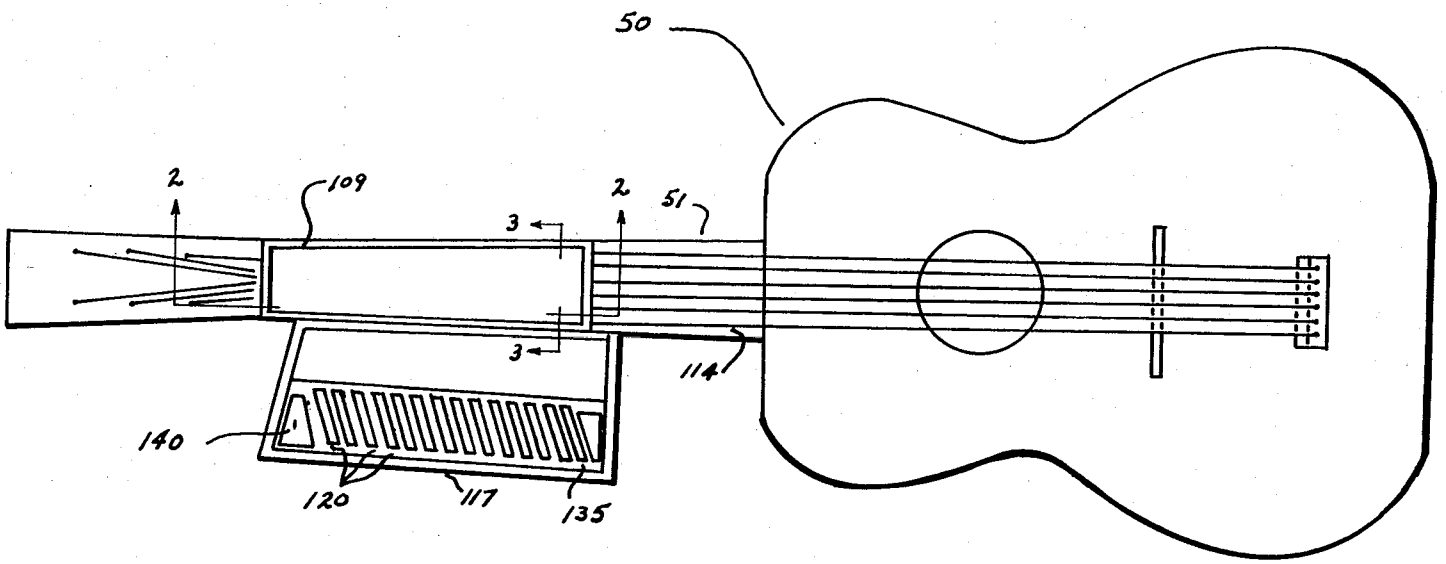
FIG. 1 is a plan view of a guitar which shows the concept and location of a keyboard.
Figure 1A:
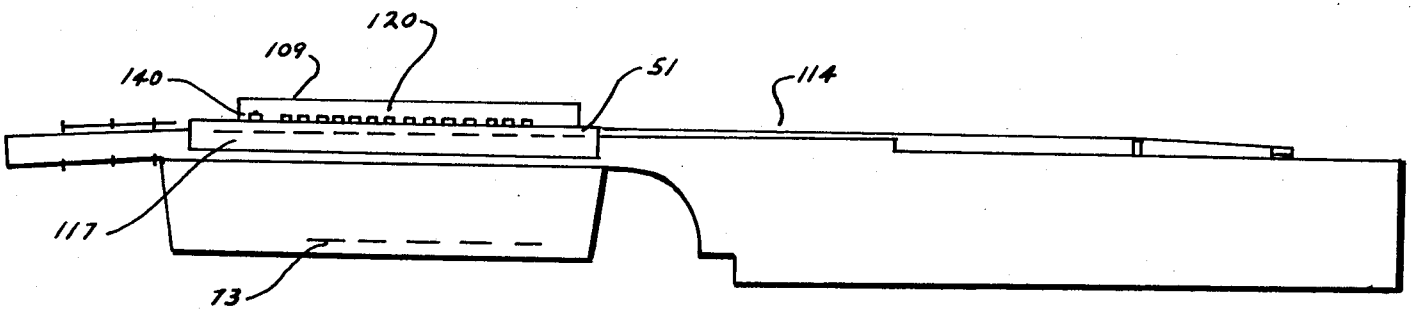
FIG. 1A is a side view of FIG. 1.
Figure 2:
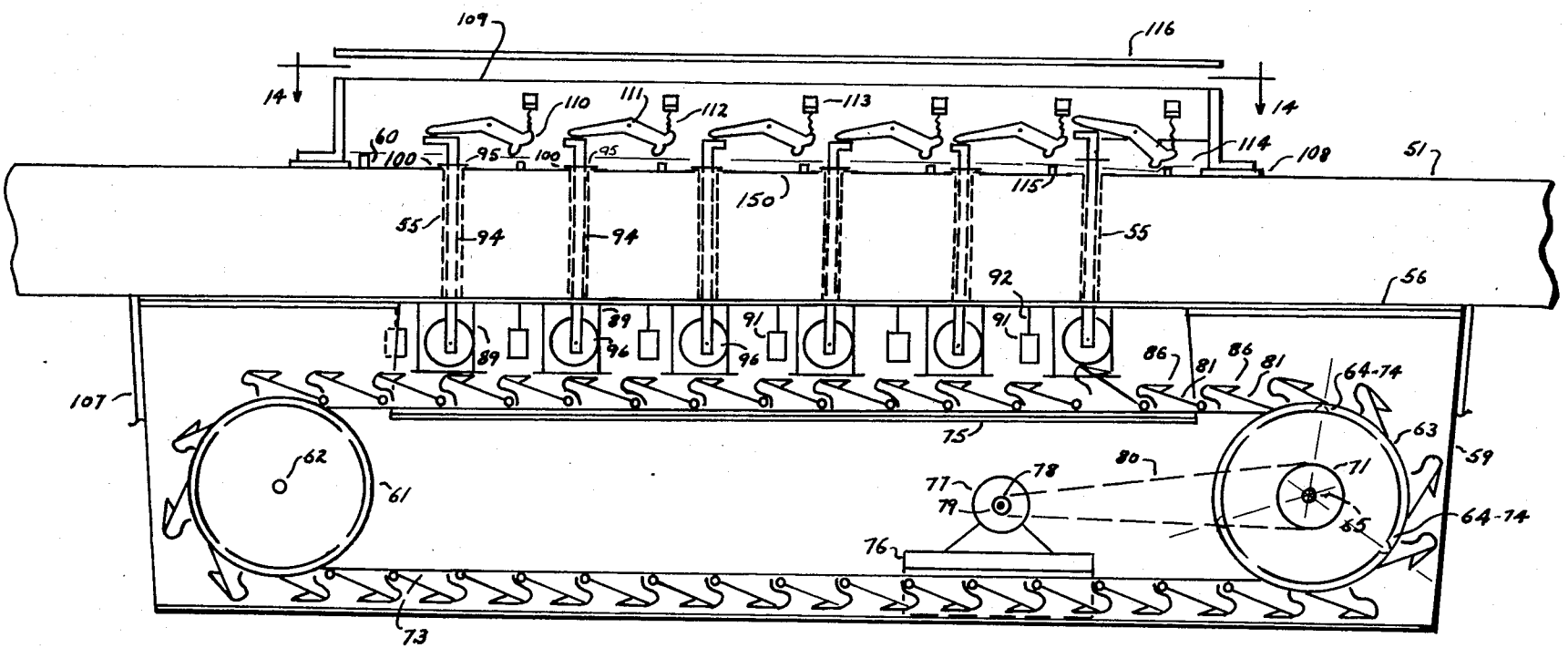
FIG. 2 is a section taken along line 2—2 of FIG. 1.

Refer to FIGS. 1, 1A, and 2.

GENERAL DESCRIPTION OF THE INVENTION

A guitar 50 has a motor driven belt chording device mounted on its neck 51. The device includes the following.

A battery powered motor 77 that is used to provide rotary driving power for a continuous belt 73 which has a plurality of cams 81, each with a cam wedge bar 86 mounted on it, fastened to its outer surface.

The cam wedge bars 86 provide displacement movement to fretting mechanisms.

Electromagnets 91, which are selectively actuable by depressing a key 120 on a fingerboard 117 are used to attract the cam bars 86 so that the cam bars 86 ride horizontally along cam bridges 88–89 surface and become wedged between the bridges 88–89 surface and a wheel 96 at the base of a fretting mechanism.

The wedging action forces a rod 94 vertically upwards so that it displaces a rocker arm 110 in a clockwise movement so it presses down on a string 114 and achieves fretting.

The device constitutes a means of gradual application of string fretting pressure in producing automatically fretted chords.

The device with its 14 key fingerboard provides the means of automatically fretting a chromatic scale of chords.

DETAILED DESCRIPTION OF THE INVENTION

FIG. 2 shows an assembly of the primary mechanical and electrical means of achieving the invention.

In this assembly, a structural mounting base frame 59 is attached to a mounting plate 56.

The mounting plate 56 is fastened to the underside of the guitar neck 51. The below the neck 51 elements of the invention are held by the structural frame 59.

Two drums, one a plain surfaced drum 61 and the other a splined drum 63, are mounted one at each end of the frame 59.

Figure 4:
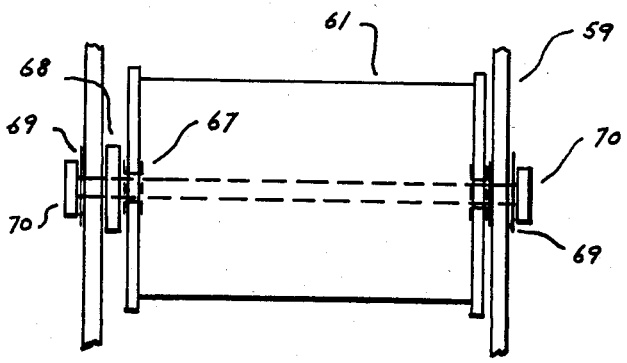
FIG. 4 is a front elevation of a fret belt drum.
Figure 5:
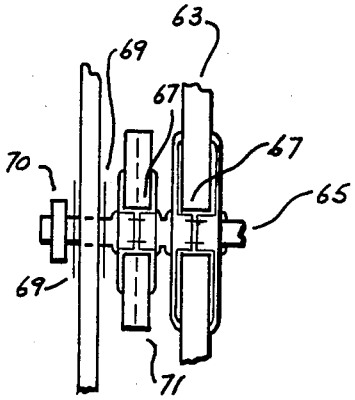
FIG. 5 is a plan view of the splined drum drive gear and splined drum axle fastenings.

Each drum is set on an axle 62, and 65, (see FIGS. 4 and 5) that is supported by the sides of the frame 59.

Hardware required in the drum mountings includes bushings such as 67, washers 68 and 69, and end nut 70.

A drum drive gear 71 is fastened to the left end of the splined drum 63 axle.

A continuous belt 73 such as would be made of vinyl or nylon is draped around the drums.

There are slots 74 across the width of the belt 73. The slots 74 are evenly spaced apart around the circumference of the belt 73.

The splines 64 on the splined drum fit into the slots 74 in the belt 73.

A drive motor 77 is fastened to the structural frame 59 by means of bracket 76.

A drive gear 78 is mounted on the motor 77 shaft.

A drive chain 80 encompasses the motor shaft drive gear 78 and the splined drum 63 gear 71.

The belt 73 is supported by the frames 59 horizontal surface 75 as it travels horizontally under the bridges 88–89 that are suspended from the underside of the guitar neck 51.

The operation of this assembly provides horizontal movement of the belt 73.

Rotary turning power from the motor 77 is transferred through the drive chain 80 and drive gears into the splined drum 63.

The splines transform the rotary power into a leverage that moves the belt.

The speed of the belt 73 would be determined by the motor shaft 79 drive gear 78 and splined drum 63 gear 71 ratio relationship.

Figure 3:
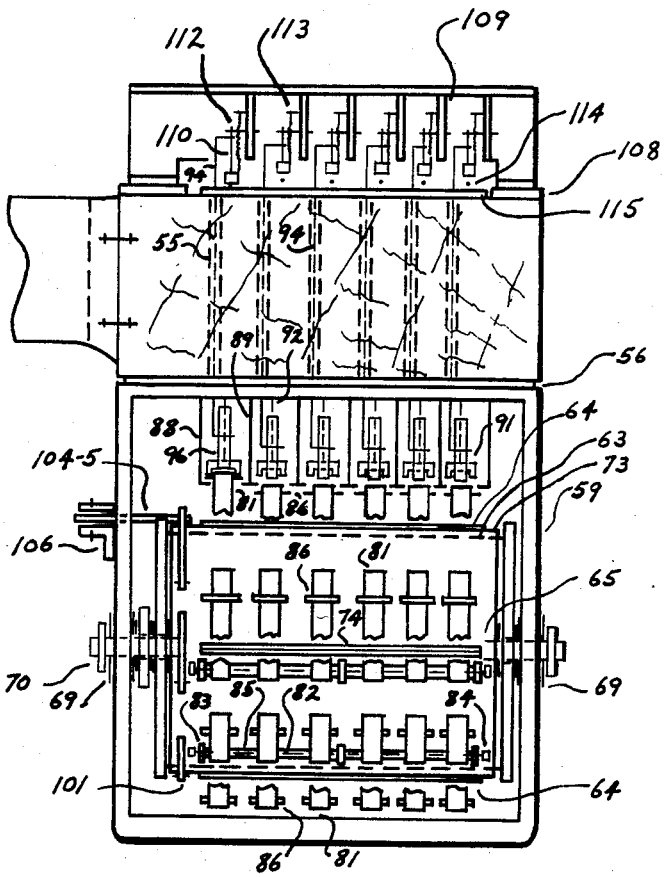
FIG. 3 is a section taken along line 3—3 of FIG. 1.

FIGS. 2 and 3 show an assembly of the secondary mechanical means of achieving the invention. The assembly includes the following.

A plurality of cams 81 are mounted on cam rods 82 that are fastened, evenly spaced, to and around the outer surface of the belt 73.

The cams 81 are in rows of 6 each.

The rods 82 are each fastened by means of three brackets 83. There is one holding bracket 83 near each end of a rod 82 and a holding bracket 83 in the center of the rod 82.

A bushing 84 is fastened to the ends of each rod 82.

Tubular spacers 85 on the cam rods 82 separate each cam rod bracket 83 from its adjacent cam 81 and each cam 81 from its adjacent cam 81.

The bushings 84 and the spacers 85 stabilize the rod 82 and its cams 81 from lateral movement.

Figure 12:
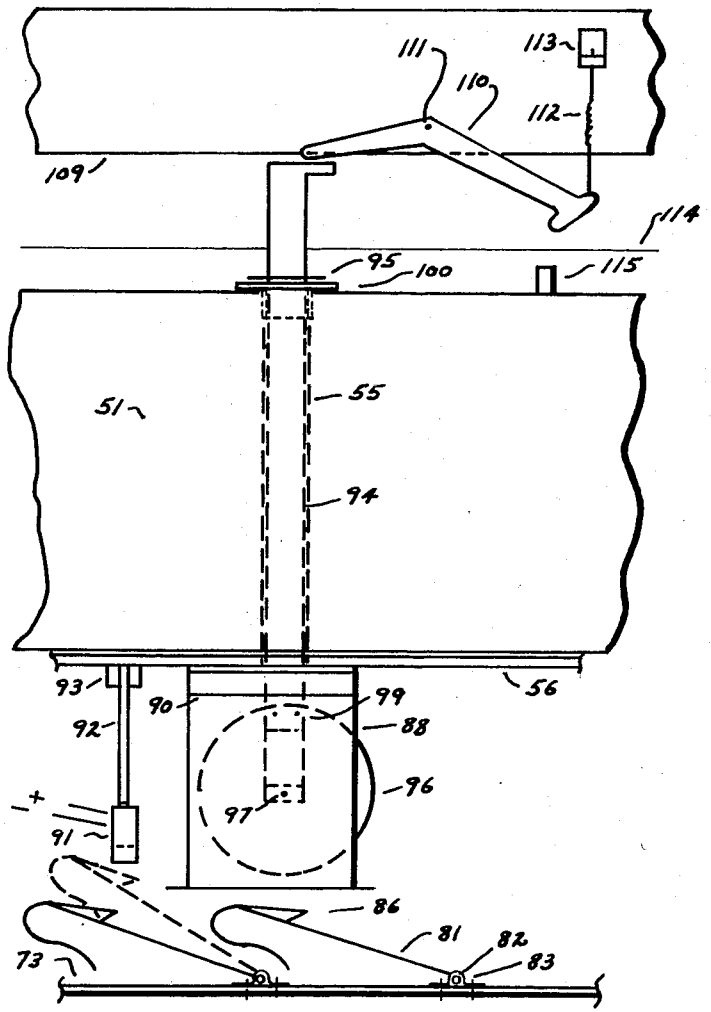
FIG. 12 is an enlarged elevation side view of a fretting mechanism.
Figure 13:
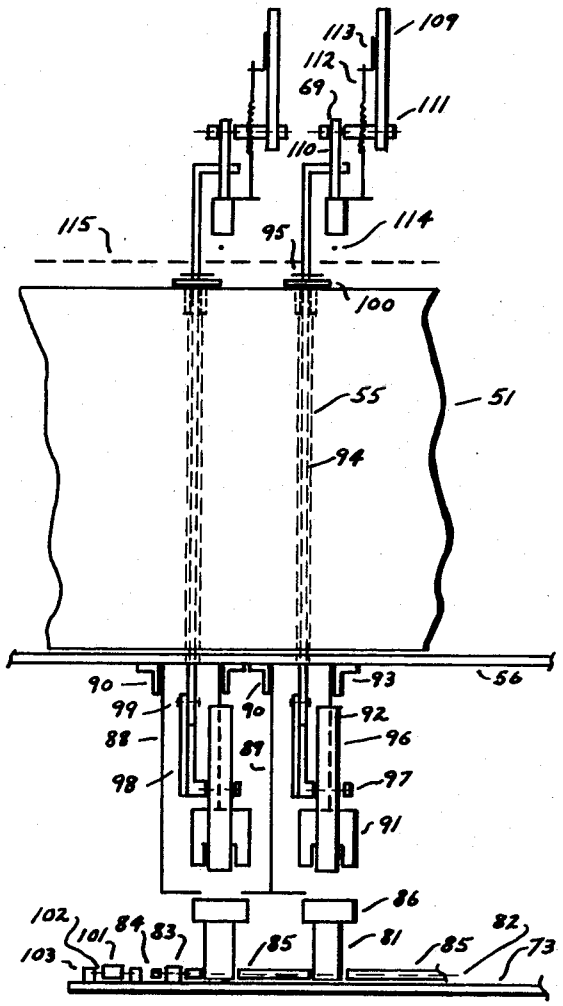
FIG. 13 is a front view of FIG. 12.
Figure 16:
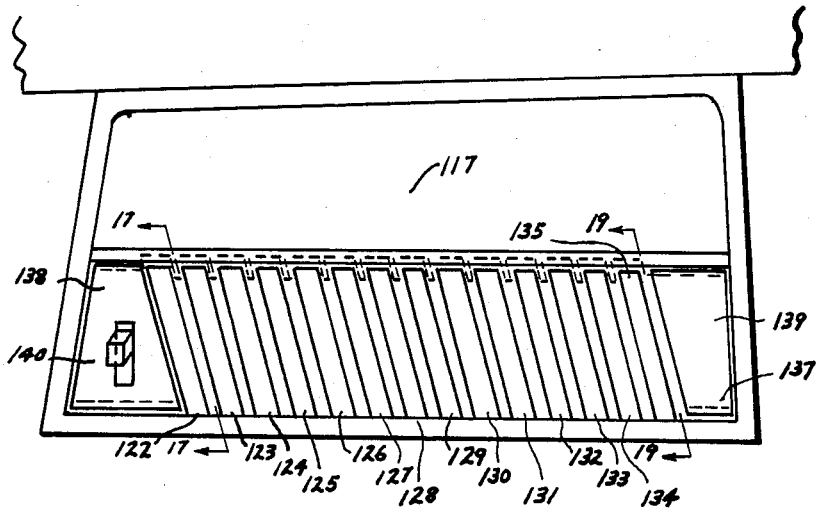
FIG. 16 is a keyboard plan view.

Also in the assembly, cam wedge bars 86 are fastened across the top surface of each cam 81. See FIGS. 12 and 13.

A cam wedge bar 86 would be made from soft iron.

A cam 81 cam wedge bar 86 unit is rotatable on a cam rod 82 so that a wedge bar 86 can be attracted toward and slide onto a bridge surface while moving horizontally.

A plurality of cam bridges 88–89 are fastened suspended from the underside of the instrument neck 51.

Interior cam bridges 89 resemble an inverted T shape. The two exterior cam bridges 88 in each row, resemble an L shape and a backward L shape respectively.

An angle bracket 90 stabilizes each bridge 87 in its fastening.

A plurality of cam lift electromagnets 91 are suspended from the underside of the instrument neck 51.

The electromagnets here referred to, are considered to be mechanical means that are controlled by the electrical means.

An electromagnet is fastened at the lower end of a plate bracket 92.

The plate bracket 92 is stabilized and fastened to the underside of the neck 51 by means of angle bracket 93.

An electromagnet 91 is shaped like an inverted channel so that clearance is provided between the electromagnet 91 and the upper curvature of the cam 81 when the electromagnet 91 attracts the cams bar 86 and while the cam 81 bar 86 unit is moved horizontally away from the magnet 91.

Finally in this assembly, a plurality of fretting mechanisms are mounted in and on the guitar neck 51.

In FIGS. 2, 3, 12, and 13, a plurality of cam push rods 94 are set in a slot-like vertical holes 55 in the guitar neck 51.

A push rod 94 resembles an elongated flat bar in its shape.

A rod 94 is made up of three pieces. The top piece extends out of the top of the neck 51, through the neck 51, and through the bottom of the neck 51. The bottom piece of the rod 94 is fastened to a gusset plate 98 that is fastened by nut and bolt 99 to the lower end of the top piece of the rod 94.

A cam wheel 96 is fastened to the bottom piece of the rod 94 by means of a cam wheel bolt pin 97.

A fixed flange 95 fastened to the top piece of the rod 94 stops the down travel of the rod when it encounters and seats on a cam rod base plate 100.

The base plate 100 is fastened at the top of the rod 94 neck 51 hole 55.

The hole in the plate 100 and the neck hole 55 are shaped similar to the rod 94 shape and therefore serve to stabilize the rod 94 from rotational movement.

The rocket arms 110 of the fretting mechanisms of the device are identical in shape and fastening.

The cam wedge bars 86 on the fret belt 73 and the cam wheels of the fretting mechanisms are each equally spaced apart, however, since the distance between the frets on a standard guitar decrease as you move from the nut to the bell of the instrument, and this necessitates unequally spaced apart fretting mechanism rocket arms 110, a cam wheel push rod 94 must be provided with a horizontal arm at its top that varies in length from one row of rods to the next.

This variation in the length of the horizontal arms of the rods 94 is the means of accomodating the requirement of unequally spacing apart the rocker arms 110.

Figure 15:
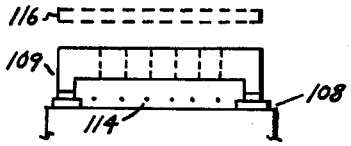
FIG. 15 is an end elevation view of the ribbed structure.
Figure 14:
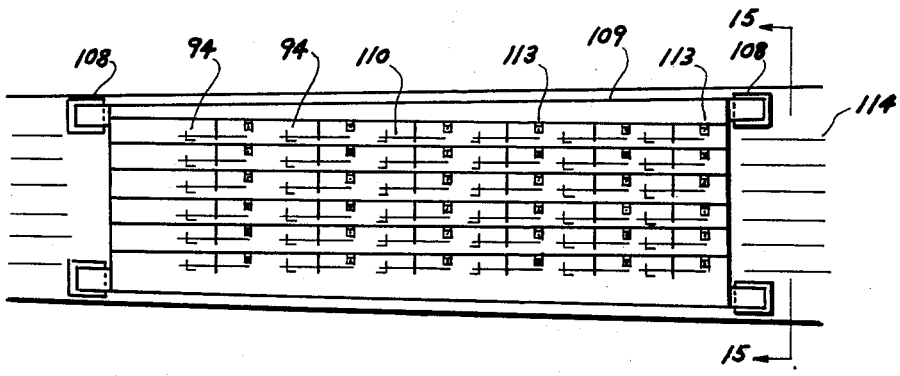
FIG. 14 is a plan view showing the rocker arm location configuration with reference to the ribbed structure.

The rocker arms 110 are fastened to a ribbed structure 109 (see FIGS. 3 and 15) that is mounted above the neck 51 of the guitar 50.

The structure 109 in this embodiment encompasses the nut 60 and the first six frets of the instruments fretboard 150.

The structure 109 is set on four mounting plates 108.

A rocker arm 110 is rotateable on its pin 111 fastening.

A tension spring 112 that is fastened between the top of the fretting end of a rocker arm 110 and an L bracket 113 that is fastened to the side of a rib of the ribbed structure 109, maintains counterclockwise tension on a rocker arm 110. In the assembly of these secondary mechanical means shown in FIGS. 2, 3, 12, and 13, the cam bridges 88–19, the electromagnets 91, and the fretting mechanisms are in correspondence to each other.

Automatic fretting is provided by these corresponding elements at a total of 21 fretboard locations.

The operation of the secondary mechanical means provide attraction of cam bars 86 by electromagnets 91, movement of the cam bars 86 over a bridge surface, actuation of fretting mechanism by cam bars 86, and production of string 114 fretting by the actuated mechanisms.

Operationally a fretting mechanism is actuated by a cam bar 86 displacing a cam wheel 96 and its push rod 94 upwards.

The movement upwards of a cam rod 94 rotates a rocket arm 110 clockwise and thus produces a leverage that is used to push the arm 110 down on a string 114, and the string down on a fret 115.

The below the neck 51 assembly is enclosed by cover 107, and the above the neck 51 is enclosed by cover plate 116.

An assembly of the secondary electrical means of achieving the invention are shown in FIGS. 16 thru 21.

A player actuated fingerboard has an on/off switch 140, thirteen chords keys 120, and a zero fret key 135. While a fingerboard key is referred to as 120 the individual chord keys in the present embodiment are identified as follows: 122 C maj., 123 D Flat min., 124 D 7th., 125 E flat maj., 126 E 7th., 127 F maj., 128 F sharp maj., 129 G maj., 130 A flat maj., 131 A 7th, 132 B flat maj., 133 B maj., and 134 C min.

A battery 151 provides an electrical source of power.

The on/off switch 140 controls the supply of electrical current to the invention.

The fingerboard 117 housing resembles a rectangular container that is held by a frame 118 that is fastened to the right hand playing side of the guitar neck 51.

The frame 118 sides are the ends of the housing, and a back plate hingeboard 119, and a key guide faceplate 141 are the sides of the housing.

The sides and a bottom plate 136 are fastened within the frame 118 area by bracket 137.

Each key 120 is fastened by hinge 121 to the hingeboard 119.

A presser limits plate 143, fastened to the front underside of a key 120, rides in a slot 142 on the inner surface of the key guide faceplate 141.

The slot 142 stabilizes the key 120 in its downtravel.

The keys 120 uptravel is stopped when the presser limits plate 143 encounters the interior top of the keys slot 142.

A return spring 144 maintains upward pressure on a key 120. The spring 144 is fastened in a cup like holder 146. The top of the spring 144 seats in a recess 145 in the underside of the key 120.

Also shown in the assembly, each key 120 has spring like curved flat metal contacts 201 that are mounted on a contacts base 147. The contacts base 147 is fastened to the top side of the bottom plate 136.

A rectangular metal contact 202 is fastened to the end of an L shaped flexible rod 148. The rod 148 is fastened to the interior front of each keys 120 slot 142 so that the 202 contact is suspended on he end of the rod 148 in the direct line of downtravel of the keys contact 201.

When a key 120 is depressed, its presser limits plate 143 is pushed down on the 201 contact(s) and forces it or them into contact with the 202 contact(s). Each 202 contact is then forced down onto its respective bottoming block 149.

A bottom block 149 is a rectangular shape piece of material that is mounted on the bottom interior surface of the keys slot 142.

Figure 18:
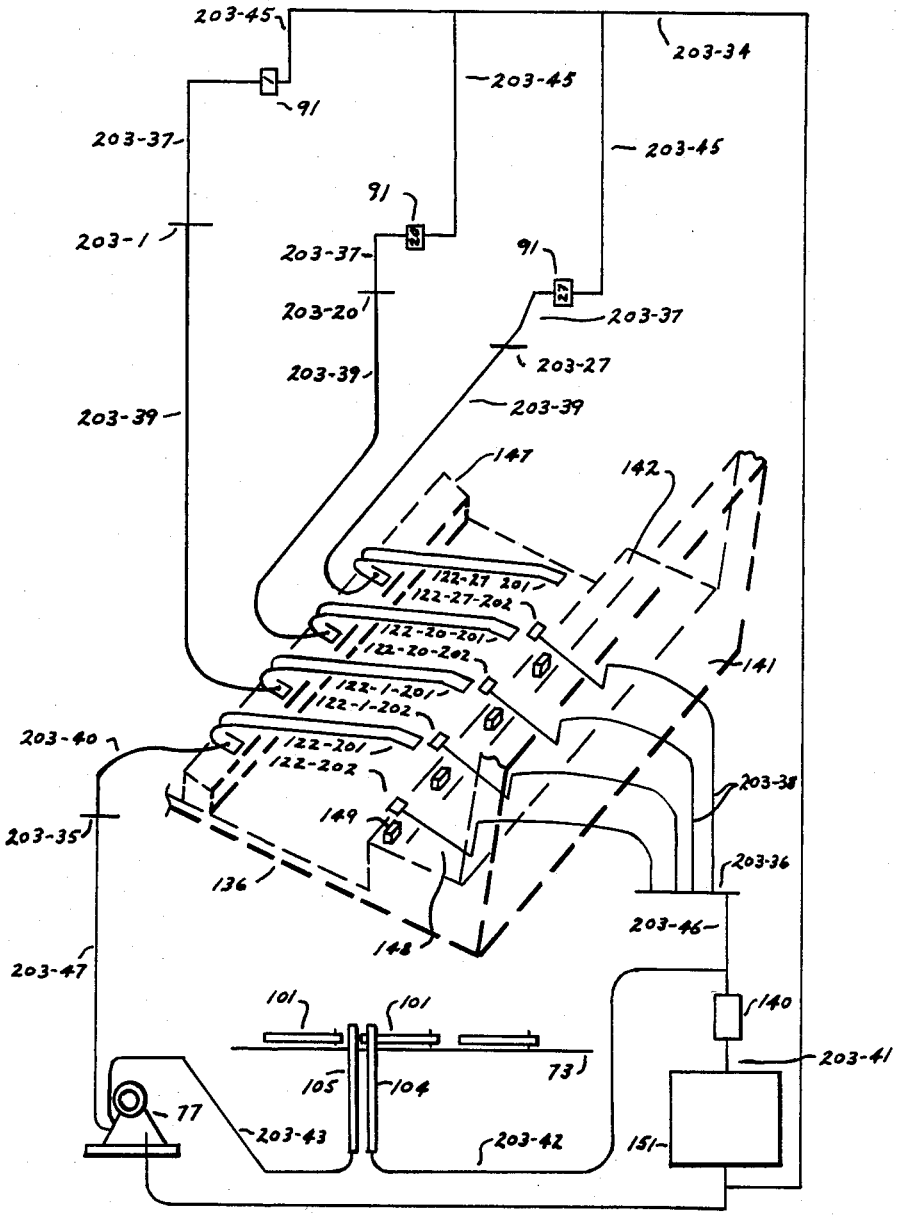
FIG. 18 is a schematic of the C maj. key electromagnet circuits and the motor primary and secondary circuits.

Note in FIG. 18 that the C maj. chord requires fretting at three positions on the fretboard.

These three positions are identified as positions 1, 20, and 27. (Also see FIG. 21 on this.)

Also note in FIG. 18 that numbers identify the key and contact type for the keys primary motor circuit, hence 122-201, and 122-202 are shown. Key 122 is the C maj. chord key.

FIG. 18 also identifies the C maj. chord key's electromagnet positions and the key's electromagnet circuit contact type, hence 122-1-201 and 122-1-202. 122-20-201 and 122-20-202, and 122-27-201 and 122-27-202 are shown. This is a typical scheme for all chord key contacts.

Figure 17:
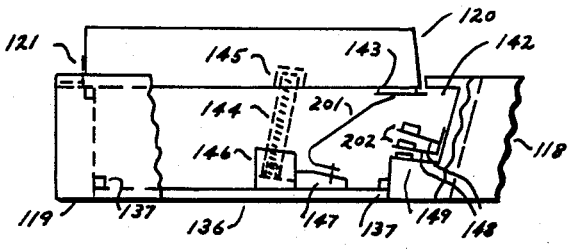
FIG. 17 is a section taken along line 17—17 of FIG. 16.

Note in FIG. 17 that the 202 contacts are shown at two levels. The 202 contacts for the electromagnet circuits are vertically at a higher lever than the primary motor circuit 202 contact. The reason for this is so that in the down travel of a key 120 the electromagnet circuit contacts of the key will close before the key's primary motor circuit contacts close.

Also in the assembly of secondary electrical means, the secondary motor circuit means are shown in FIG. 7.

A plurality of elongated metal strips 101, are mounted equally spaced apart along the outer edge on the drive side of the belt 73.

A metal strip 101 is fastened by means of a lateral pin 102.

The strip 101 is wrapped around the pin 102.

The pin is held by a clip 103 at each end.

The clips 103 are riveted to the belt 73.

The length of an elongated metal strip 101 and the distance between two adjacent strips 101, would depend on the distance that the fret belt 73 would have to travel in order to move a wedge bar 86 one increment, which would be equal to the distance between the center lines of two adjacent cam wheels 96.

Two parallel bar contacts 104 and 105, (see FIGS. 6, 7, and 11) are mounted on a bracket 106 that is fastened to the side of the frame 59.

In the operation of the secondary electrical means, a chord key 120 is depressed and released to provide sequentially, closing the key's electromagnet circuit contacts, closing the key's primary motor circuit contacts, opening the key's primary motor circuit contacts, and opening the key's electromagnet circuit contacts.

The short interval of time that the primary motor circuit contacts are closed, provides a minimal energy to the belt 73 motor 77, so that the motor "nudges" or moves the belt, a short distance.

While the belt 73 moves this short distance, parallel bars 104–105 become bridged by the next subsequent elongated metal strip 101 on the belt 73 edge.

Bridging the parallel bars 104–105 completes the secondary motor circuit.

Completing the secondary motor circuit prolongs the motors 77 operation and the belt is driven an added distance.

While the belt is traveling this added distance, the wedge bar(s) that were attracted by the key's electromagnets, ride on the surface of an adjacent bridge or bridges 88–89.

The attracted wedge bar(s) in traveling the bridge surface encounter the adjacent fretting mechanisms cam wheels 96, are slid between the bridge surface and the cam wheel(s) 96 of the mechanism(s) and actuate the mechanism(s).

The actuated fretting mechanism(s) produce fretting.

The motor stops as parallel bar 105 rides off the passing elongated metal strip 101 and the secondary motor circuit is opened.

The belt is stopped in a fretting attitude.

The belt has been nudged a minimal distance and driven an added distance. The total travel distance is one increment.

Figure 20:
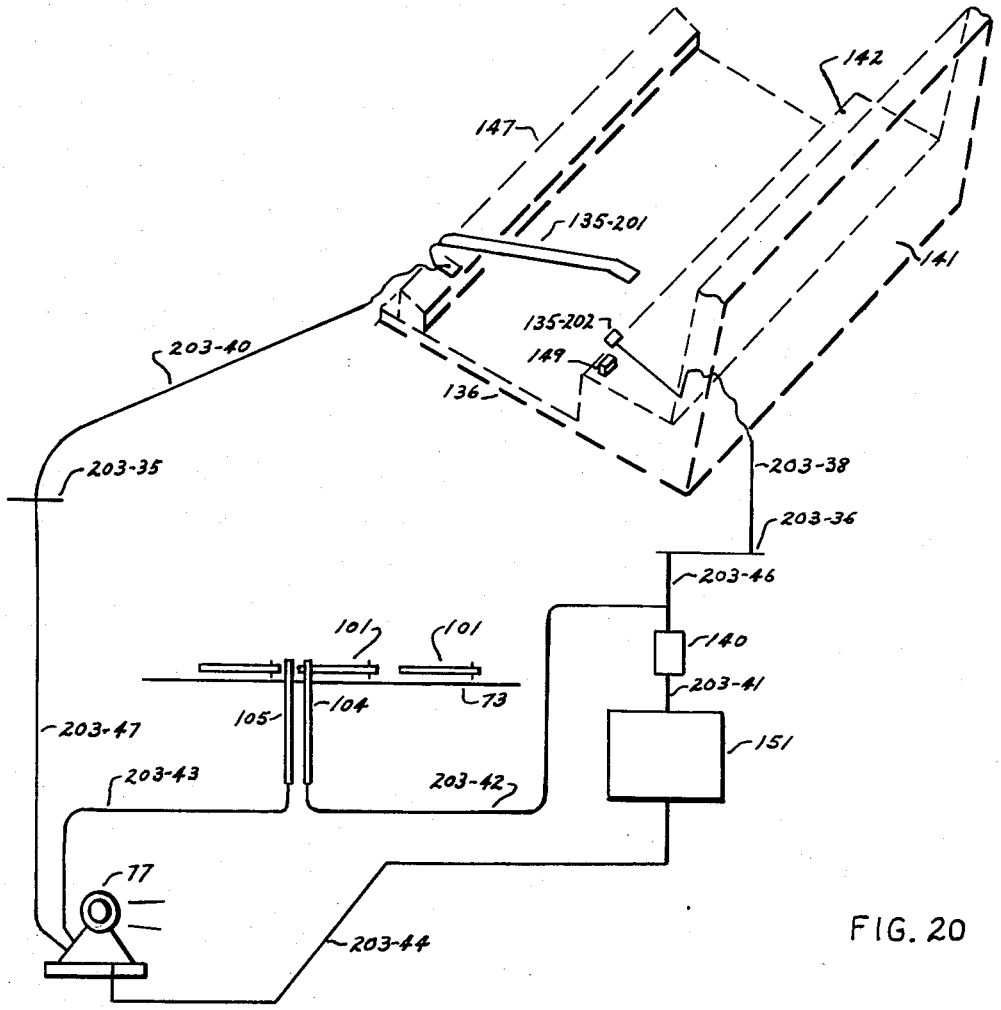
FIG. 20 is a schematic of the zero fret key primary and secondary motor circuits.
Figure 19:
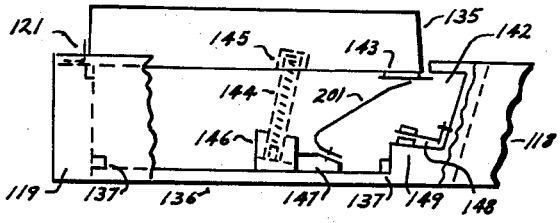
FIG. 19 is a section taken along line 19—19 of FIG. 16.

Finally in the assembly of secondary electrical means, a zero fret key 135 means is as shown in FIGS. 19 and 20.

The zero fret key 135 means includes the same parts as a typical chord key 120, that is a key, a hinge, springs etc., and as set of primary motor circuit contacts. There are no electromagnet circuits associated with the zero fret key 135.

Operationally, pressing the zero fret key 135 provides completion of the primary motor circuit and its resultant completion of the secondary motor circuit.

The zero fret key 135 moves the fret belt 73 one increment.

The zero fret key 135 provides the means of moving the fretting belt 73 from a fretting attitude to a non-fretting attitude after use so that the instrument can be stored with no pressure on its strings 114.

In reusing the device after storage or non-use, the first chord key 120 used to produce fretting, moves the fret belt from the off non-fretting attitude to a fretting attitude.

In subsequent use of the device the chord keys 120 move the fretting belt 73 from fretting attitude to fretting attitude.

Figure 21:
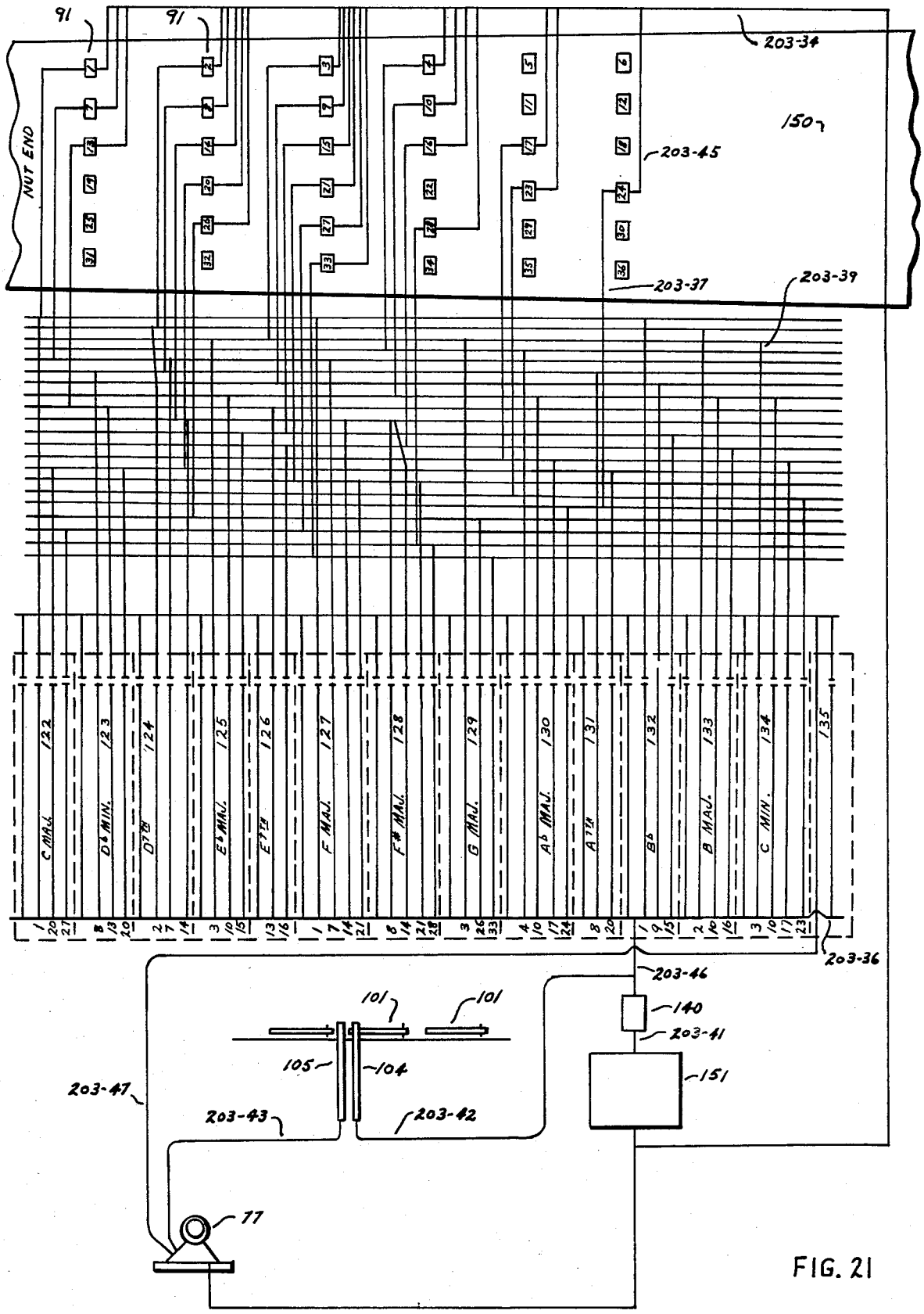
FIG. 21 is an electrical circuit plan view for the device.

FIG. 21 shows the inventions circuit wiring.

It shows the on/off switch 140 for turning the invention on or off, a battery 151 to provide electrical current for the invention, and wiring for each of the thirteen chord keys 120, and the zero fret key 135.

The figure shows twenty one access wires common to each key's cam 81 wedge 86 lift electromagnets 91 positive side, and the key's 201 contacts.

In order to provide fretting of thirteen chords, it is necessary to be able to activate combinations of electromagnets 91 in twenty one different positions on the fretboard 150. FIG. 21 shows the twenty one numbered positions.

FIG. 21 also shows access wire 203-34 common to the negative side of the battery 151 and to the negative side of each electromagnet 91, access wire 203-35 common to the negative side of each primary motor 77 circuit contact 201 and to the positive side of the motor 77, access wire 203-36 common to the positive side of each 202 contact, and to the negative side of the on/off switch 140, wire 203-37, one from the positive side of each electromagnet 91 to the numbered access wire 203-1 thru 203-33 the electromagnet 91 corresponds to, wire 203-38, one from each 202 contact to access wire 203-36, wire 203-39, one from each chord key electromagnet circuit contact 201 to the keys corresponding access wires among the 203-1 thru 33 wires, wire 203-40, one from each keys primary motor 77 circuit 201 contact to access wire 203-35, wire 203-41 from the positive side of the on/off switch 140 to the positive side of the battery 151, wire 203-42 from the negative side of the on/off switch 140 to the away from belt 73 end of positive bar contact 104, wire 203-43 from the away from belt 73 end of negative bar contact 105 to the positive side of the motor 77, wire 203-44 from the negative side of the motor 77 to the negative side of the battery 151, wire 203-45, one from the negative side of each electromagnet 91 to access wire 203-34, wire 203-46 from access wire 203-36 to the negative side of the on/off switch 140, and wire 203-47 from access wire 203-35 to the positive side of the motor.

As shown in FIG. 21, the primary motor 77 circuit of each key 120 is identified by the letters BN which stands for the term "belt nudge". This term was referred to in the copy above.

What is claimed is:

1. A stringed musical instrument fretting device comprising:

a body means consisting of: a structural frame to fasten the below the neck parts of the invention to, said frame being attached to a mounting plate that is fastened to the underside of the neck of the instrument, a ribbed structure to fasten the above the neck parts of the invention to, said structure being attached to mounting plates that are fastened to the upper side of the neck of the instrument, a fingerboard frame to hold thirteen keys and a zero fret key, said frame being attached to the left side of the neck of the instrument, a fretting mechanism means consisting of:

a plurality of cam bridges each constituting a horizontal surface suspended from the underside of the guitar neck so that a wedge bar can be lifted and caused to ride along said surface, a plurality of cam wheel-push rod-rocker arm fretting mechanism assemblies that are disposed above said bridges and where said wedge bar can be made to slide between said bridge and the wheel of said assembly causing it and the push rod attached to it to move up so that it contacts one end of said rocker arm and rotates it and causes it to push a string down on a fret, an electromagnetic/fret mechanism actuating means consisting of:

a fret belt with a plurality of cams fastened to the surface of said belt where each cam has a wedge bar fastened across the width of it, a plurality of electromagnets for selectively lifting said cam wedge bar assemblies as said belt is driven and they pass under said electromagnets causing said cam bar to be lifted and ride said bridges and be slid between said bridges and said cam wheels to thereby cause string fretting, an electrical circuit means consisting of:

a primary motor/electromagnet circuit which is made up of a DC motor connected to an on/off switch which is connected to thirteen chord keys and one zero fret key, each said key containing circuit means to actuate one or a combination of said electromagnets and circuit means to actuate said belt drive motor when said key is depressed down and released, said motor actuation being charachterized a "belt nudge" because the motor remains on just long enough to nudge or move the belt a short distance, and a secondary motor circuit which has two fixed parallel but separated contact probes mounted projecting over the edge of said belt and elongated metal strips fastened to and along the edge of said belt so that while said belt is being "nudged" by said primary circuit, said contact probes are bridged by said strips to thus cause said motor to remain on until said probe contact bridging is stopped when one probe rides off said strip to thus stop the motor.

2. The apparatus of claim 1 wherein said fretting mechanism means comprise cam wheel and push rod assembly means disposed in holes in the neck of the instrument for transmitting the displacement action of the fret belt cam wedge bars, rocker arms each of which is held in contact with the top of its corresponding push rod by means of a tension spring which provides said arm with a counterclockwise pushing pressure, said arm pushing down on the top of said rod, and push rod vertical downward travel limiting means which is a base plate that is encountered by a push rod stop when said rod moves vertically in its neck hole.

3. The apparatus of claim 1 wherein said fret belt means comprise a plain surfaced drum, splined drum, structural frame assembly means where said drums are mounted on said frame and said belt is draped around them, and belt driving leverage means comprise splines which are provided across the width dimension of said splined drum in multiple locations on the drums circumference surface, and slots in said belt which said splines fit into, and belt driving means comprising a chain encompassing a drive gear on the shaft of a drive motor that is mounted on said structural frame within the interior area of the belts loop, and a drive gear mounted on the axel and hub of said splined drum.

4. The apparatus of claim 1 wherein each of 36 electromagnets is held by a bracket suspended between said belt and said instruments neck underside, and is positioned in correspondence to a fretting position and disposed adjacent to a said bridge so that when a said cam wedge bar is lifted by said electromagnet it slides onto said bridge surface.

5. The apparatus of claim 1 wherein said zero fret key is provided only with the primary motor actuating circuit means and the secondary motor circuit means—its purpose being to move said belt into a non fretting attitude after use of said device.

6. The apparatus of claim 1 wherein said fretting belt cams are arranged in rows of six that are evenly spaced around said belt, and have fastening means where the fastened end of each cam is wrapped around a cam rod that is fastened to said belt by a bracket at each end and center and is stabelized from sideward movement by a fixed bushing at each extreme end, and cam rod spacing means comprising tubes that are mounted on said rods between said cams.

* * * * *